US007040103B2

(12) United States Patent
Schwarz et al.

(10) Patent No.: US 7,040,103 B2
(45) Date of Patent: May 9, 2006

(54) COOLING SYSTEM, A COOLER AND A METHOD FOR CONTROLLING A COMPRESSOR

(75) Inventors: Marcos Guilherme Schwarz, Joinville (BR); Marcio Roberto Thiessen, Joinville (BR)

(73) Assignee: Empresa Brasileira de Compressores S.A. - Embraco, Joinville-SC (BR)

( * ) Notice: Subject to any disclaimer, the term of this patent is extended or adjusted under 35 U.S.C. 154(b) by 124 days.

(21) Appl. No.: 10/250,346

(22) PCT Filed: Jan. 11, 2002

(86) PCT No.: PCT/BR02/00004

§ 371 (c)(1),
(2), (4) Date: Jan. 20, 2004

(87) PCT Pub. No.: WO02/055944

PCT Pub. Date: Jul. 18, 2002

(65) Prior Publication Data

US 2004/0168453 A1 Sep. 2, 2004

(30) Foreign Application Priority Data

Jan. 11, 2001 (BR) ..... 0100052

(51) Int. Cl.
*G05D 23/32* (2006.01)

(52) U.S. Cl. ..... 62/157; 62/231; 62/230; 62/228.5

(58) Field of Classification Search ..... 62/157, 62/228.5, 230, 231; 417/12
See application file for complete search history.

(56) References Cited

U.S. PATENT DOCUMENTS

| | | | | |
|---|---|---|---|---|
| 3,894,282 | A | 7/1975 | MacFarland, Jr. | |
| 4,653,285 | A * | 3/1987 | Pohl | 62/126 |
| 4,722,019 | A | 1/1988 | Pohl | |
| 6,453,693 | B1 * | 9/2002 | Ewert et al. | 62/236 |
| 6,487,869 | B1 * | 12/2002 | Sulc et al. | 62/230 |
| 2004/0051490 | A1 * | 3/2004 | Jayanth | 62/127 |

FOREIGN PATENT DOCUMENTS

| | | |
|---|---|---|
| DE | 198 04 330 A1 | 8/1999 |
| GB | 2 202 966 A | 10/1988 |

OTHER PUBLICATIONS

International Search Report, EPO, May 21, 2002.

* cited by examiner

*Primary Examiner*—Marc Norman
*Assistant Examiner*—B. Clayton McCraw
(74) *Attorney, Agent, or Firm*—Alston & Bird LLP

(57) ABSTRACT

A cooling system comprising a compressor (20) and controlled by means of an electronic circuit (TE), the electronic circuit (TE) comprising a measuring circuit (ME) for measuring an electric power (Pn) supplied to the compressor (20) a microcontroller (10), a time variable (td), the measuring circuit (ME) effecting a measurement of the electric power (Pn) supplied the compressor (20), the microcontroller (10) comparing the measure. An electric power with reference-power values (Prl) and (Prd) previously stored in the microcontroller (10), the microcontroller altering the state of operation of the compressor (20) in function of the electric power (Pn) and of the time variable (td). A method of controlling a compressor (20), which comprises steps of storing a variable (Pn(te)) at a power value (Pn) measured at the moment when a period of time (te) counted from the moment of turning on the compressor (20) has been, and altering the value of the time variable (tD).

15 Claims, 2 Drawing Sheets

COOLING SYSTEM, A COOLER AND A METHOD FOR CONTROLLING A COMPRESSOR

BACKGROUND OF THE INVENTION

1. Field of the Invention

The present invention relates to a system and a method for controlling the actuation of a compressor and particularly a compressor applied to cooling systems in general, this system and method enabling one to eliminate the use of thermostats or other means of measuring temperature usually employed in this type of system.

2. Description of the Related Art

The basic objective of a cooling system is to maintain low temperature inside one (or more) compartment(s), making use of devices that transport heat from the interior of this (these) environment(s) to the external environment. It uses the measurement of the temperature inside this (these) environments to control the devices responsible for transporting heat, trying to keep the temperature within limits pre-established for the type of cooling system in question.

Depending upon the complexity of the cooling system and of the kind of application, the temperature limits to be maintained are more restricted or not.

One usual way of transporting heat from the interior of a cooling system to the external environment is to use a hermetic compressor connected to a closed circuit through which a cooling fluid circulates, wherein the compressor has the function of providing the flow of cooling gas inside the cooling system, being capable of imposing a determined difference in pressure between the points where evaporation and condensation of the cooling gas occur, whereby it enables the processes of transporting heat and creating low temperature to take place.

The compressors are sized to supply a capacity of cooling higher than that required in a normal situation of operation, foreseen critical situations of demand. In this case, some type of modulation of the cooling capacity of this compressor is necessary to maintain the temperature inside the cabinet within acceptable limits.

The most usual way of modulating the cooling capacity of a compressor is to turn it on and off according to the evolution of the temperature in the environment being cooled, by making use of a thermostat that turns the compressor on when the temperature in the environment being cooled exceeds a pre-established limit, and turns it off when the temperature in this environment has reached a lower limit, also pre-established.

The known solution for this device of controlling the cooling system is the use of a bulb containing a fluid that expands and contracts with temperature, installed in such a way that it will be exposed to the temperature inside the environment to be cooled and mechanically connecting an electromechanical switch that is sensitive to this expansion and contraction of the fluid inside the bulb. It is capable of turning the switch on and off at predefined temperatures, according to the application. This switch interrupts the current supplied to the compressor, controlling its operation, maintaining the internal environment of the cooling system within pre-established temperature limits.

This is still the most widely used type of thermostat, since it is relatively simple, but it has drawbacks such as fragility during the mounting, because this is an electromechanical device containing a bulb with pressurized fluid and also has limitation of quality due to the constructive variability and wear. This generates a relatively high cost of repair in the field, because it is linked to an equipment of high aggregate value.

Another known solution for controlling a cooling system is the use of an electronic circuit capable of reading the temperature value inside the environment being cooled, by means of a PTC-type (Positive Temperature Coefficient) electronic-temperature sensor, for example, or some other type. The circuit compares this read temperature value with predefined references, generating a command signal to the circuit that manages the energy delivered to the compressor, providing correct modulation of the cooling capacity, so as to maintain the desired temperature in the internal environment being cooled, be it by turning on or off the compressor, or by varying the delivered cooling capacity.

This solution provides a quite reliable and precise control of the temperature, further enabling one to perform more complex or additional functions. It is found in more sophisticated systems, which have a higher aggregate value.

A drawback is the relatively higher cost when compared with that of the electromechanical solution and, at best, with an equivalent cost for simple versions, when the device is employed in the basic function of keeping the temperature within certain limits.

Another solution for controlling the temperature in an environment being cooled is described in document U.S. Pat. No. 4,850,198, which discloses a cooling system that comprises a compressor, condenser, expansion valve and evaporators, besides providing control over energizing the compressor. This control is effected by means of a microprocessor in accordance with a temperature readout from a thermostat determining the energizing or no energizing of the compressor on the basis of the maximum and minimum predetermined temperature limits. According to this system, one still foresees control over time of operation of the compressor as a function of the temperate measured in the environment being cooled.

BRIEF SUMMARY OF THE INVENTION

One objective of the present invention is to provide means for controlling 10 the temperature inside a cooling system, eliminating altogether the use of thermostats or other temperature-measuring means for controlling the cooler, thus achieving a more simple control, eliminating unnecessary electric connections in the system for installation of the temperature sensor, and obtaining a cheaper system.

Another objective of the present invention is to provide a method for controlling a compressor, wherein the use of a temperature sensor is dispensed with, so as to obtain an economically more efficient construction.

The objectives of the present invention are achieved by means of a cooling system comprising a compressor that is electrically fed and controlled by means of an electronic circuit. The electronic circuit comprises a circuit for measuring an electric power supplied to the compressor and a microcontroller. A time variable is stored in the microcontroller, the measuring circuit measures the electric power supplied to the compressor, the microcontroller compares the measurement of the electric power with reference power values previously stored in the microcontroller, the microcontroller alters the operation status of the compressor as a function of the electric power and of the time variable.

Further, the objectives of the present invention are still achieved by means of a compressor-controlling method comprising the steps of storing, in a variable, the power value measured at the moment when a period of time counted from the moment of turning on compressor has passed, and altering the value of a time variable corresponding to a time in which the compressor remains off, as a function of a proportion of value of the variable and a previously-stored value.

BRIEF DESCRIPTION OF THE DRAWINGS

The present invention will now be described in greater detail, with reference to an embodiment represented in the drawings. The figures show.

DETAILED DESCRIPTION OF THE INVENTION

Figure 1:
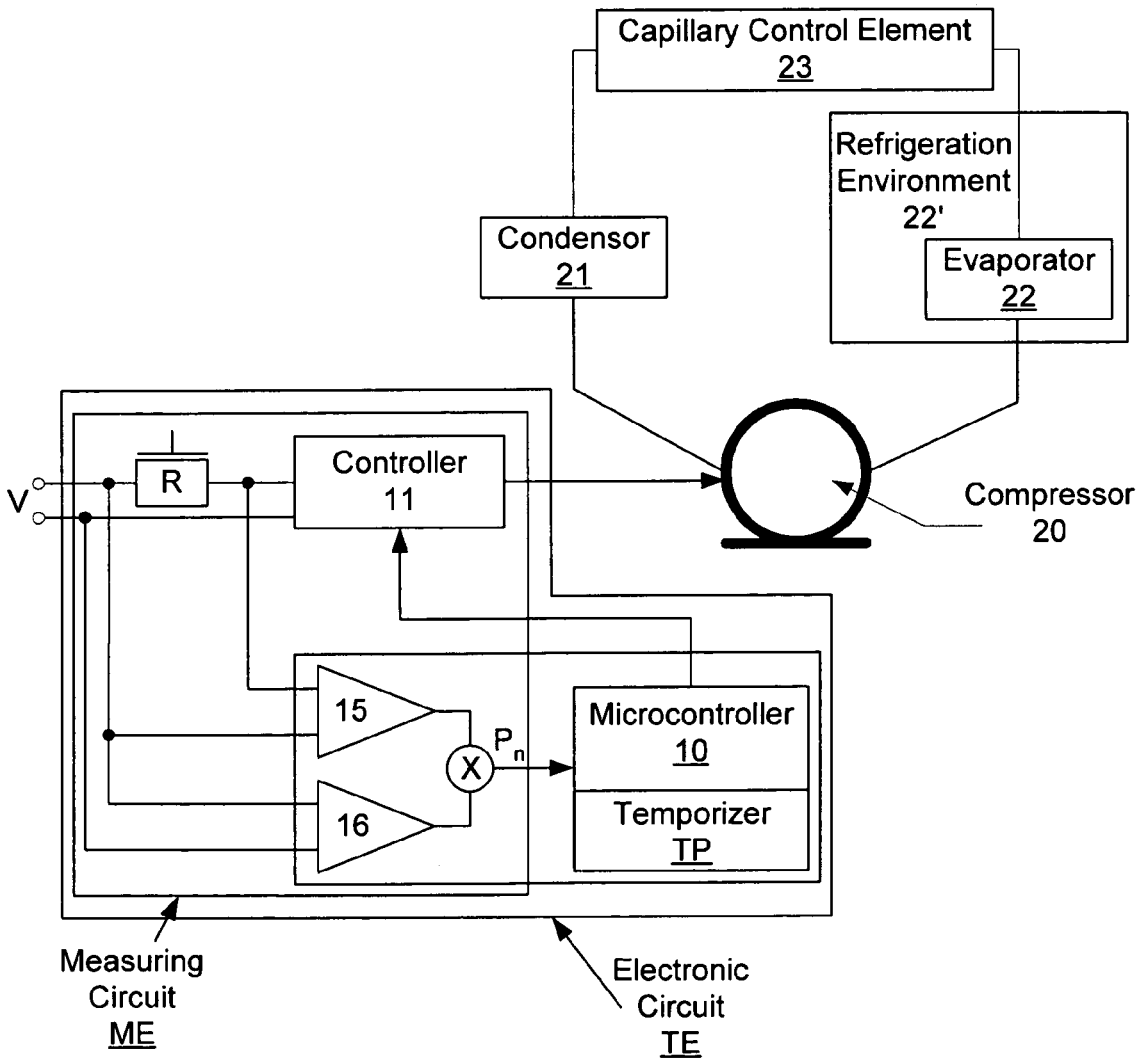
FIG. 1: a schematic diagram of the compressor-controlling system according to the present invention.

As can be seen in FIG. 1, the system basically comprises a condenser 21, an evaporator 22, a capillary control element 23 and a compressor 20. The condenser 21 is positioned outside the environment to be cooled or refrigeration environment 22', while the evaporator 22 is positioned inside the refrigeration environment 22' for supplying the cooled-air mass. Control over the compressor 20 is carried out by means of a control circuit TE, which in turn is composed by a microcontroller 10 provided of a temporizer TP, in addition to a measuring circuit ME for measuring the electric power Pn supplied to the compressor 20.

According to the present invention and based on the fact that the power $P_n$ absorbed by the compressor 20 in a cooling system represents a very strong direct correlation with the temperature from evaporation of the cooling gas, which in turn represents, with good approximation, the temperature inside the cooled cabinet or refrigeration environment 22'. One may use as a reference the value of electric power $P_n$ absorbed by the compressor 20 to determine when the temperature in the cabinet has reached the expected value, then turning off the compressor 20. The correlation is valid, since as the volume of coolant in circulation decreases, the absorbed electric power $P_n$ decreases and, besides, as the temperature in the refrigeration environment 22' decreases less fluid is evaporated, and therefore less fluid circulates, thus reducing the absorbed electric power $P_n$.

This means that, as the temperature in the refrigeration environment 22' decreases, the gas-evaporation temperature also decreases, and one can observe a proportional decrease in the electric power $P_n$ absorbed by the compressor 20. If one compares it with predefined references $P_{rl}$, $P_{rd}$ ($P_{rl}$—maximum temperature power variable; $P_{rd}$—minimum temperature power variable), one can define the moment of turning off the compressor 20 or changing its cooling capacity, thus controlling the temperature inside the refrigeration environment 22', without the need for temperature sensors, as is the case in the prior art.

Thus, in order to maintain the temperature in the refrigeration environment 22' within an adequate range, the compressor 20 is turned on and off intermittently by means of the controller TE, which updates the temporizer TP, which will allow one to turn on the compressor 20 again, after a determined time has passed, initiating a new cooling cycle. This wait time until the compressor is turned on again may be dynamically adjusted as a function of the electric power $P_n$ absorbed by the compressor 20, right after the beginning of operation at each new cycle, since this power $P_n$ will reflect the temperature inside the refrigeration environment 22' at the moment of turning on the compressor 20 again, and may be adjusted by correction of this time in which the compressor 20 is kept off.

As can be seen in FIG. 1, for measurement of the electric power $P_n$, the measuring circuit ME includes means 15, 16, which enable one to measure the voltage and current supplied to the compressor and make the product of these quantities, which will result in power value supplied to the compressor. These means feed this power information to a microcontroller circuit 10 responsible for actuating the compressor 20 by means of a controller 11. The measurement of the electric power $P_n$ is carried out by reading the current I that circulates in the resistor R and by reading the voltage V applied to the compressor 20, such values being multiplied by each other to obtain the electric power $P_n$ value. The electric power $P_n$ should still be corrected as a function of the power factor when an alternate-current compressor 20 is used. One may also apply correction of the value of power absorbed by the compressor in function of the feed voltage value, compensating the variations in efficiency presented by the motor at different feed voltages.

In order to operate the system of the present invention, two values of electric power are determined: minimum temperature power variable $P_{rd}$ corresponding to the minimum temperature desired inside the refrigeration environment 22'; and the maximum temperature power variable $P_{rl}$ corresponding to the maximum temperature desired inside the refrigeration environment 22'.

The intermittence control of the compressor 20 is carried out by the microcontroller 10, which compares the measured electric power $P_n$ value absorbed by the compressor with a minimum temperature power variable $P_{rd}$ corresponding to the minimum temperature desired for the interior of the cabinet being cooled, commanding the turning-off of the compressor when the measured electric power $P_n$ value is equal or lower than this minimum temperature power variable $P_{rd}$, keeping the compressor off during a period of time predefined by a variable td(n), commanding the turning-on of the compressor 20 again immediately after this time td(n) has passed.

After turning on the compressor 20 again and after the stabilization time or wait time te has passed, the microcontroller 10 will take the measured power value $P_n$(te) to effect correction of the variable td(n), calculating the new value of td(n+1) in function of the proportion between the power value $P_n$(te) measured right after the start of functioning of the compressor and the value of the maximum temperature power variable $P_{rl}$.

Thus, when the power value P(te) at the beginning of an operation cycle is higher than the maximum temperature power variable $P_{rl}$, the time during which the compressor 20 remains off in the next stoppage cycle td(n+1) should be reduced. In the same way, the time during which the compressor 20 remains off in the next stoppage cycle (td(n+1) should be increased if the power $P_n$(te) measured right after the start of operation of the compressor 20 is lower than the maximum temperature power variable $P_{rl}$.

An implementation of this process may be carried out by the algorithm:

$$Td(n+1)=td(n)*Prl/Pn(te)$$

Figure 2:
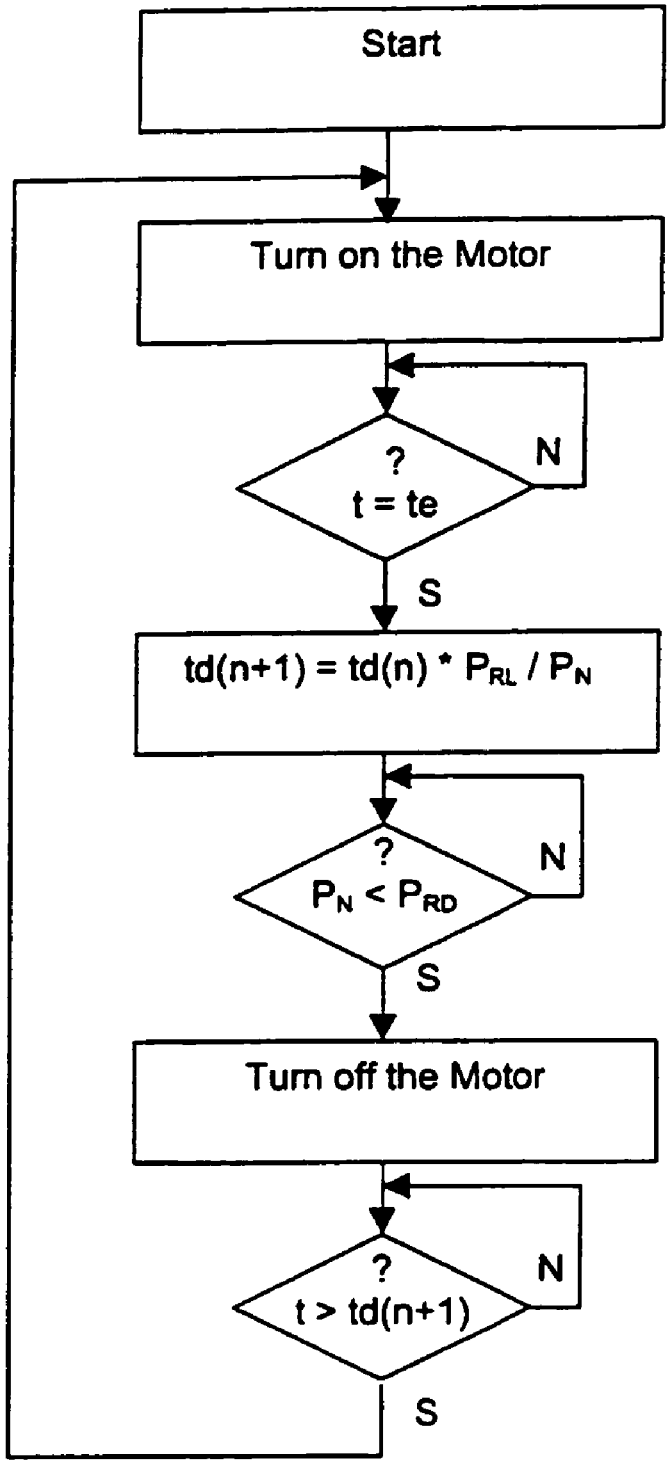
FIG. 2: a flow diagram of the compressor-controlling method according to the present invention.

This equation of the proposed electronic circuit TE circuit is summed up by the flow diagram illustrated in FIG. 2, wherein the method should include at least the step of storing the variable $P_n$(te) of the power value $P_n$ measured at the moment when a period of wait time te counted from the moment of turning off the compressor 20 has passed, and an additional step of altering the value of a time variable $t_d$ in function of the proportion of the variable value $P_n$(te) and the maximum temperature power variable $P_{rl}$, which is already previously stored in the microcontroller 10.

The wait time te should be determined by the project and should be sufficient for the compressor to accelerate after the start, thus preventing the power value read right after the start from becoming distorted due to the compressor-acceleration energy and due to the establishment of the initial system-operation pressures.

Also, a maximum time during which the compressor 20 remains inactive Tdm should be foreseen, so that the compressor can be turned on again.

The minimum temperature power variable $P_{rd}$ as well as the maximum temperature power variable $P_{rl}$ are defined by the project, or they may be defined at the assembly line of the cooling system, by making use of a temperature sensor belonging to the process in the assembly line of the cooler, which will measure the temperature inside the refrigeration environment 22' and send a signal to the electronic circuit TE of the compressor 20 when the desired minimum and maximum temperatures are reached, enabling this electronic circuit TE to memorize the power value $P_{rd}$ and maximum temperature power variable $P_{rl}$ references: minimum temperature power variable $P_{rd}$ and maximum temperature power variable $P_{rl}$.

A preferred embodiment having been described, one should understand that the scope of the invention embraces other possible variations, being limited only by the contents of the accompanying claims, which include the possible equivalents.

The invention claimed is:

1. A cooling system comprising a compressor fed electrically and controlled by control circuit for controlling said compressor, wherein said control circuit comprises:

a measuring circuit for measuring an electric power supplied to the compressor; and a microcontroller, wherein a time variable (td) is stored in the microcontroller, and the measurement circuit effects a measurement of the electric power ($P_n$) supplied to the compressor, the microcontroller compares the measure of the electric power with a maximum temperature power variable ($P_{rl}$) and a minimum temperature power variable ($P_{rd}$) previously stored in the microcontroller, the minimum temperature power variable ($P_{rd}$) corresponding to the minimum temperature desired inside the refrigeration environment and the maximum temperature power variable ($P_{rl}$) corresponding to the maximum temperature desired inside the refrigeration environment, and the microcontroller alters the state of operation of the compressor as a function of the electric power ($P_n$) and of the time variable (td), wherein said compressors is selectively turned on and off by said microcontroller, wherein the on and off time of the compressor is varied based on the electric power absorbed by the compressor.

2. A system according to claim 1, wherein said compressor is selectively turned on and off by the microcontroller, the compressor remaining on until the value of electric power ($P_n$) absorbed by the compressor is lower than or equal to the minimum temperature power variable ($P_{rd}$), and remaining off for a time variable (td), this time variable (td) being proportional to the relationship between the maximum temperature power variable ($P_{rl}$) and measured power value ($P_n$(te)) of power absorbed by the compressor at the start of its operation cycle.

3. A system according to claim 2, wherein the measurement of the electric power ($P_n$) is stored at a variable corresponding to the measured power value ($P_n$(te)) at each start of the time cycle in which the compressor remains on, after a wait time (te) counted from the turning-on of the compressor has passed.

4. A system according to claim 3, wherein the wait time (te) corresponds to a wait time for stabilization of the compressor.

5. A system according to claim 3, wherein the value of the time-reference variable is high when the value of the measured electric power ($P_n$(te)) is lower than the value of the maximum temperature power variable ($P_{rl}$) previously stored.

6. A system according to claim 3, wherein the value of the time variable (td) is decreased when the value of the measured electric power ($P_n$(te)) is higher than the value of the maximum temperature power variable ($P_{rl}$) previously stored.

7. A system according to claim 3, wherein the electronic circuit is provided with a temporizer capable of measuring the time variable (td) and turning on the compressor when the time variable (td) is longer than a maximum time of inactivity of the compressor ($T_{dm}$).

8. A cooler comprising a cooling system as defined in claim 1.

9. A method for controlling a compressor fed electrically and controlled by an electronic circuit that keeps the compressor alternately on and off, to cool a refrigeration environment, the electronic circuit delivering an electric power ($P_n$), said method comprising the steps of:

storing a measure power value $P_n$(te)) of the electric power ($P_n$) measured at the moment when a wait time (te) counted from the moment of turning on the compressor has passed;

altering the value of a time variable ($t_D$) corresponding to a time when the compressor remains off as a function of a proportion of the value of the measured power value ($P_n$(te)) and a maximum temperature power variable ($P_{rl}$) previously stored in the electronic circuit.

10. A method according to claim 9, wherein, after the step of altering the time variable ($t_D$), the compressor is turned off when the power value ($P_n$) is lower than or equal to a minimum temperature power variable ($P_{rd}$) proportional to the minimum temperature of the refrigeration environment, is kept off during the period of time variable (td) and is kept on after the period of time variable (td) has passed.

11. A method according to claim 9, wherein prior to the step of turning off the compressor, the method comprises a step of comparing the power value ($P_n$) with a minimum temperature power variable ($P_{rd}$).

12. A method according to claim 9, wherein prior to the step of storing the measured power value ($P_n$(te)), the compressor is kept on as long as the power ($P_n$) is higher than the minimum temperature power variable ($P_{rd}$).

13. A method according to claim 9, wherein in the step of altering the time variable ($t_D$), the time variable ($t_D$) is increased when the measured power value ($P_n$(te)) is lower than the previously-stored maximum temperature power variable ($P_{rl}$) corresponding to a maximum value of temperature in the refrigeration environment.

14. A method according to claim 9, wherein during the time when the compressor is turned on, its cooling capacity is corrected in the proportion of the power value ($P_n$).

15. A method according to claim 9, wherein in the step of altering the time variable ($t_D$), the time variable ($t_D$) is reduced when the value of the measured power is at least as great as the previously-stored maximum temperature power variable ($P_{rl}$) corresponding to a maximum value of temperature in the refrigeration environment.

* * * * *

UNITED STATES PATENT AND TRADEMARK OFFICE

CERTIFICATE OF CORRECTION

PATENT NO. : 7,040,103 B2
APPLICATION NO. : 10/250346
DATED : May 9, 2006
INVENTOR(S) : Schwarz et al.

It is certified that error appears in the above-identified patent and that said Letters Patent is hereby corrected as shown below:

Column 6,

Line 26, “measure” should read --measured--.

Signed and Sealed this

Twenty-first Day of November, 2006

JON W. DUDAS
*Director of the United States Patent and Trademark Office*